US011351651B2

(12) United States Patent
Sekiya

(10) Patent No.: US 11,351,651 B2
(45) Date of Patent: Jun. 7, 2022

(54) CUTTING APPARATUS

(71) Applicant: DISCO CORPORATION, Tokyo (JP)

(72) Inventor: Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 651 days.

(21) Appl. No.: 16/188,712

(22) Filed: Nov. 13, 2018

(65) Prior Publication Data

US 2019/0143480 A1 May 16, 2019

(30) Foreign Application Priority Data

Nov. 16, 2017 (JP) ..... JP2017-221030

(51) Int. Cl.
*B24B 41/00* (2006.01)
*B24B 27/00* (2006.01)
(Continued)

(52) U.S. Cl.
CPC ..... *B24B 41/005* (2013.01); *B24B 27/0069* (2013.01); *B24B 27/0683* (2013.01); *B24B 41/002* (2013.01); *B24B 41/067* (2013.01)

(58) Field of Classification Search
CPC ... B24B 41/005; B24B 41/067; B24B 41/002; B24B 45/00; B24B 45/003; B24B 45/006; B24B 27/0683; B24B 27/0069; B24B 7/228; B24B 37/04; B24B 37/042; B28D 5/0094; B28D 5/0088; B28D 5/022; B28D 5/023; B28D 5/026; B28D 5/029
(Continued)

(56) References Cited

U.S. PATENT DOCUMENTS 5,718,615 A * 2/1998 Boucher ..... B23D 59/002 125/13.01
2006/0111021 A1* 5/2006 Gerber ..... B24B 53/02 451/11

FOREIGN PATENT DOCUMENTS

JP 08339977 A 12/1996
JP 2011011299 A * 1/2011
(Continued)

OTHER PUBLICATIONS

JP-2011255458-A Translation (Year: 2011).*
(Continued)

*Primary Examiner* — Tyrone V Hall, Jr.
*Assistant Examiner* — Makena S Markman
(74) *Attorney, Agent, or Firm* — Greer, Burns & Crain, Ltd.

(57) ABSTRACT

A cutting apparatus includes a chuck table for holding a workpiece thereon, a cutting unit for cutting the workpiece held on the chuck table with a cutting blade secured in place on a distal-end portion of a spindle by a mount flange mounted on the distal-end portion of the spindle, an indexing feed unit for moving the cutting unit in indexing feed directions parallel to axial directions of the spindle, a processing feed unit for moving the chuck table in processing feed directions perpendicular to the indexing feed directions, and an end face correction unit for correcting an end face of the mount flange that supports the cutting blade in contact therewith. The processing feed unit includes a table moving base that supports the chuck table thereon and an actuating mechanism for moving the table moving base. The end face correction unit is fixedly mounted on the table moving base.

13 Claims, 6 Drawing Sheets

(51) Int. Cl.
*B24B 41/06* (2012.01)
*B24B 27/06* (2006.01)

(58) Field of Classification Search
USPC ..... 451/11, 69, 420, 424, 444, 443, 459
See application file for complete search history.

(56) References Cited

FOREIGN PATENT DOCUMENTS

| | | | | |
|---|---|---|---|---|
| JP | 2011016182 | A | * | 1/2011 |
| JP | 2011224666 | A | * | 11/2011 |
| JP | 2011255458 | A | * | 12/2011 |
| JP | 5226394 | B2 | * | 7/2013 |
| JP | 2017019043 | A | | 1/2017 |

OTHER PUBLICATIONS

Nishimoto (JP-5226394-B2) Translation (Year: 2009).*
Matsuyama (JP-2011224666-A), Translation (Year: 2011).*
Yasuda (JP2011011299A) Translation (Year: 2011).*
Yasuda, (JP2011016182A) Translation (Year: 2011).*

* cited by examiner

CUTTING APPARATUS

BACKGROUND OF THE INVENTION

Field of the Invention

The present invention relates to a cutting apparatus having an end face correction unit for correcting the end face of a mount flange by which a cutting blade is mounted on a spindle.

Description of the Related Art

Generally, a cutting apparatus for cutting a workpiece such as a wafer or the like has a cutting blade fixed to the distal end of a spindle by a mount flange. In use, the mount flange has an annular end face held in contact with a side surface of the cutting blade, which is sandwiched between the mount flange and a fixing nut threaded over the mount flange. If the end face of the mount flange has deposits or flaws thereon, then the end face of the mount flange tends to develop surface irregularities. The end face with such surface irregularities grips the cutting blade in partial contact therewith. Furthermore, the end face of a mount flange may be oblique to a plane that lies perpendicularly to the axis of rotation of the spindle. The oblique end face grips the cutting blade in partial contact therewith. When the cutting blade cuts the workpiece, the cutting blade thus gripped by the end face of the mount flange in partial contact therewith is likely to deflect with respect to the axis of rotation of the spindle or to rotate in an oblique plane, possibly chipping the workpiece or damaging the cutting blade itself. Therefore, it has been customary to perform an end face correction process periodically or upon cutting blade replacement by polishing the end face of a mount flange with a polishing grinding stone to planarize the end face into a flat surface perpendicular to the axis of rotation (see, for example, Japanese Patent Laid-Open No. Hei 8-339977 and Japanese Patent Laid-Open No. 2017-19043).

SUMMARY OF THE INVENTION

The end face correction process is carried out while the processing or production of workpieces is being interrupted. Specifically, a dedicated jig with a polishing grinding stone secured thereto is fastened to a dedicated chuck table, and the polishing grinding stone is brought into contact with the end face of the mount flange that is rotating, thereby polishing the end face of the mount flange. In the end face correction process, consequently, it is necessary to replace a chuck table that supports the workpiece with the dedicated chuck table, to put in the dedicated jig with the polishing grinding stone secured thereto, and to make adjustments to place the polishing grinding stone and the end face of the mount flange into given working positions. After the end face of the mount flange has been polished, the dedicated chuck table is replaced with the chuck table that supports the workpiece, and the cutting blade is brought into contact with the surface of the chuck table that has replaced the dedicated chuck table to establish again a reference position for an incising feed direction. Accordingly, it is highly tedious and time-consuming, requiring a number of man-hours, to perform the end face correction process.

It is therefore an object of the present invention to provide a cutting apparatus which is capable of performing an end face correction process easily with a reduced number of man-hours.

In accordance with an aspect of the present invention, there is provided a cutting apparatus comprising a chuck table for holding a plate-shaped workpiece thereon, a cutting unit for cutting the workpiece held on the chuck table with a cutting blade secured in place on a distal-end portion of a spindle by a mount flange mounted on the distal-end portion of the spindle, an indexing feed unit for moving the cutting unit in indexing feed directions parallel to axial directions of the spindle, a processing feed unit for moving the chuck table in processing feed directions perpendicular to the indexing feed directions, and an end face correction unit for correcting an end face of the mount flange that supports the cutting blade in contact therewith, wherein the processing feed unit includes a table moving base that supports the chuck table thereon and an actuating mechanism for moving the table moving base, and the end face correction unit is fixedly mounted on the table moving base.

With the above arrangement, inasmuch as the end face correction unit for correcting the end face of the mount flange is mounted on the table moving base of the processing feed unit for moving the chuck table in the processing feed directions, it is not necessary to replace the chuck table with a dedicated chuck table and to put in a dedicated jig with a polishing grinding stone secured thereto. As a result, the number of man-hours involved in an end face correction process is reduced, and the end face correction process can be performed with ease.

In the above arrangement, the end face correcting unit may include a holder that holds a polishing grinding stone and a positioning unit for placing the holder selectively in an operative position wherein the polishing grinding stone is held in contact with the end face of the mount flange and a retracted position wherein the polishing grinding stone is retracted away from the mount flange. With this arrangement, when the cutting unit cuts the workpiece, the positioning unit can place the holder that holds the polishing grinding stone in the retracted position wherein the polishing grinding stone is retracted away from the mount flange. The polishing grinding stone and the holder are thus prevented from obstructing the cutting operation of the cutting unit. When the cutting unit stops cutting the workpiece, the positioning unit can place the holder that holds the polishing grinding stone in the operative position wherein the polishing grinding stone is held in contact with the end face of the mount flange. The polishing grinding stone is thus allowed to correct the end face with ease.

According to the present invention, since the end face correction unit for correcting the end face of the mount flange is mounted on the table moving base of the processing feed unit for moving the chuck table in the processing feed directions, it is not necessary to replace the chuck table with a dedicated chuck table and to put in a dedicated jig with a polishing grinding stone secured thereto. As a result, the number of man-hours involved in an end face correction process is reduced, and the end face correction process can be performed with ease.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

A cutting apparatus according to an embodiment of the present invention will be described in detail below. Any restrictions are not particularly imposed in the embodiment to be described hereinafter. The components described below cover those which could easily be envisaged by those skilled in the art and those which are essentially identical to those described below. Furthermore, the arrangements described below can be used in appropriate combinations. Various omissions, replacements, or changes of the arrangements may be made without departing from the scope of the present invention.

Figure 1:
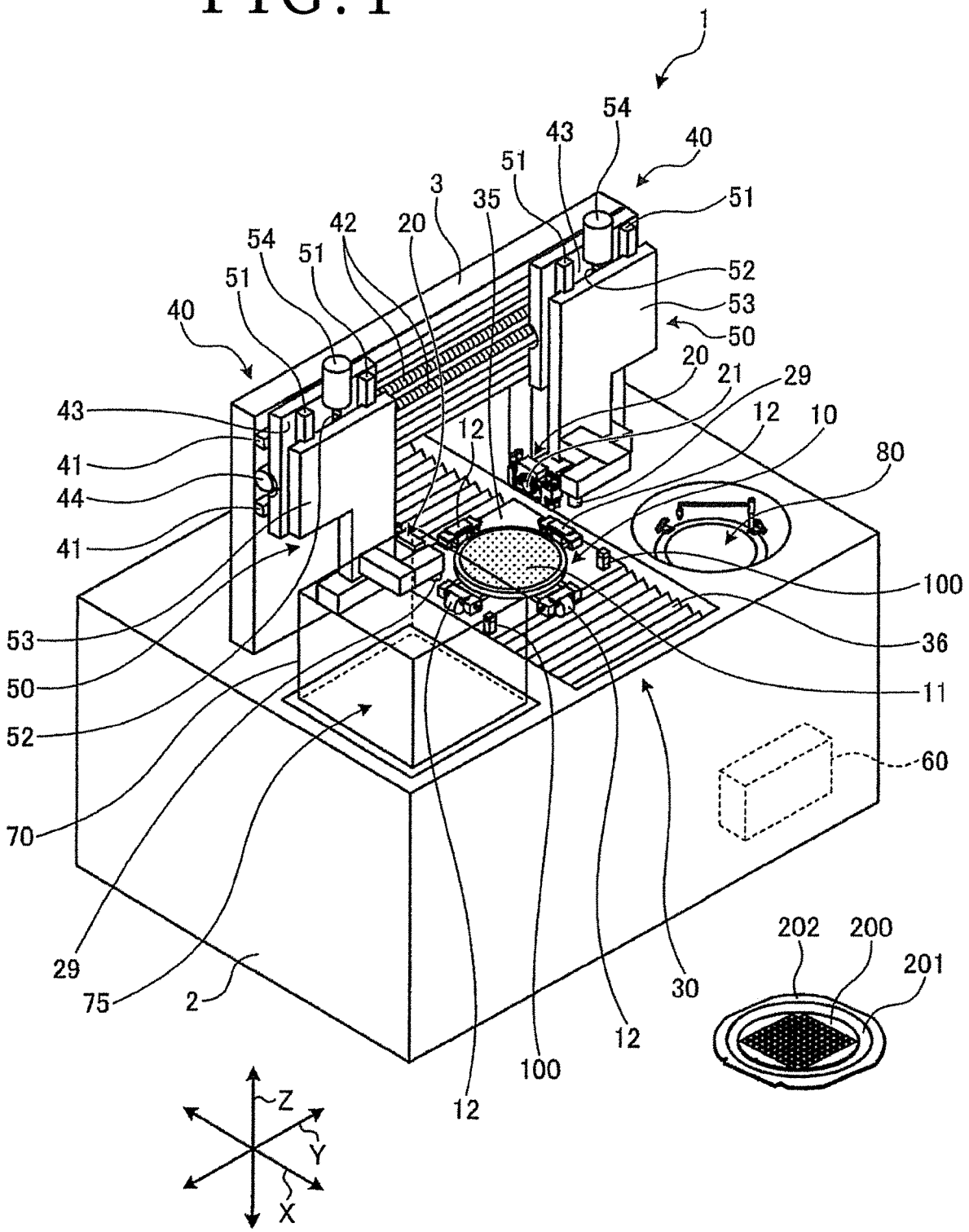
FIG. 1 is a perspective view of a cutting apparatus according to an embodiment of the present invention.
Figure 2:
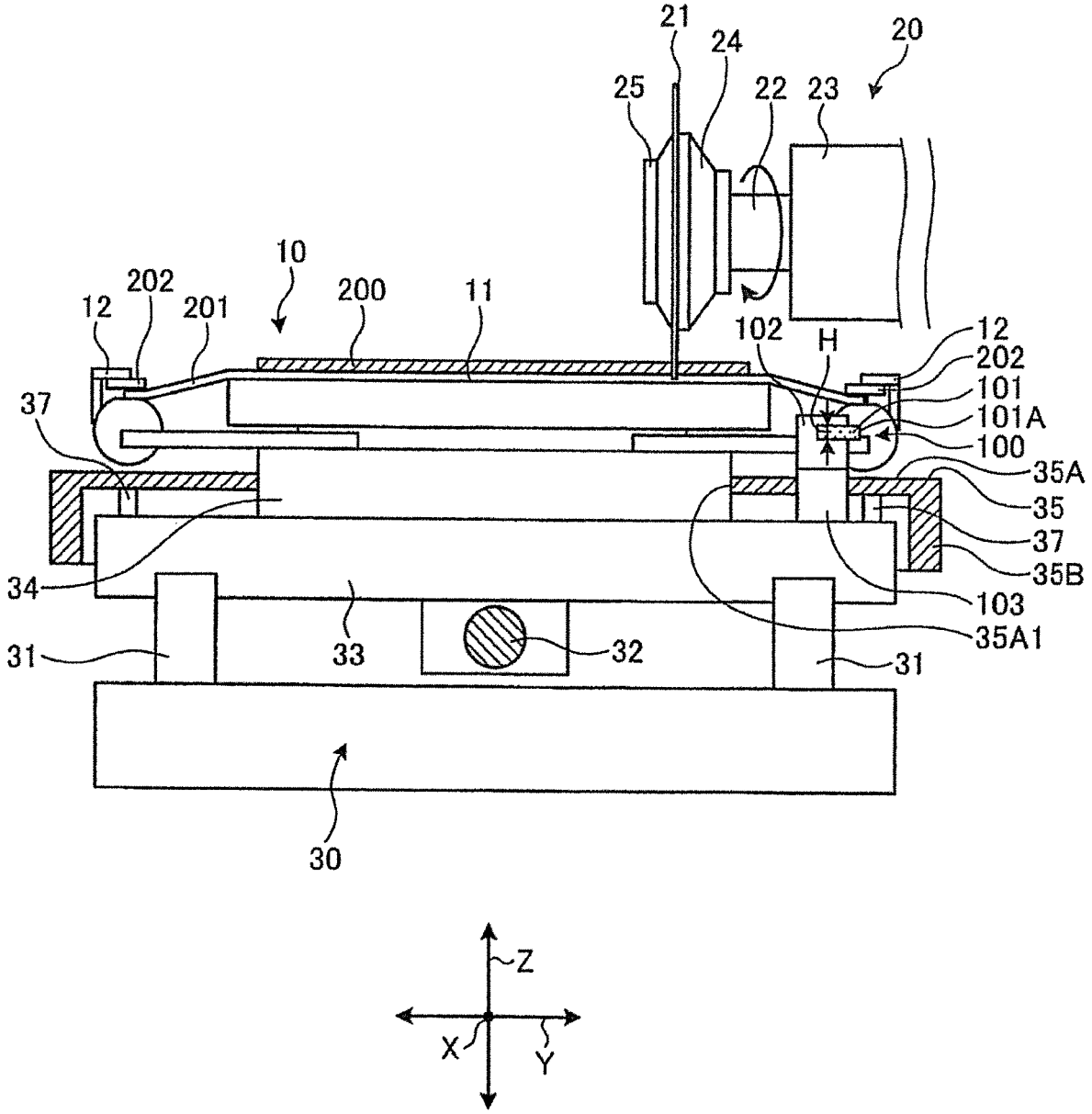
FIG. 2 is an elevational view, partly in cross section, of a processing feed unit of the cutting apparatus.
Figure 3:
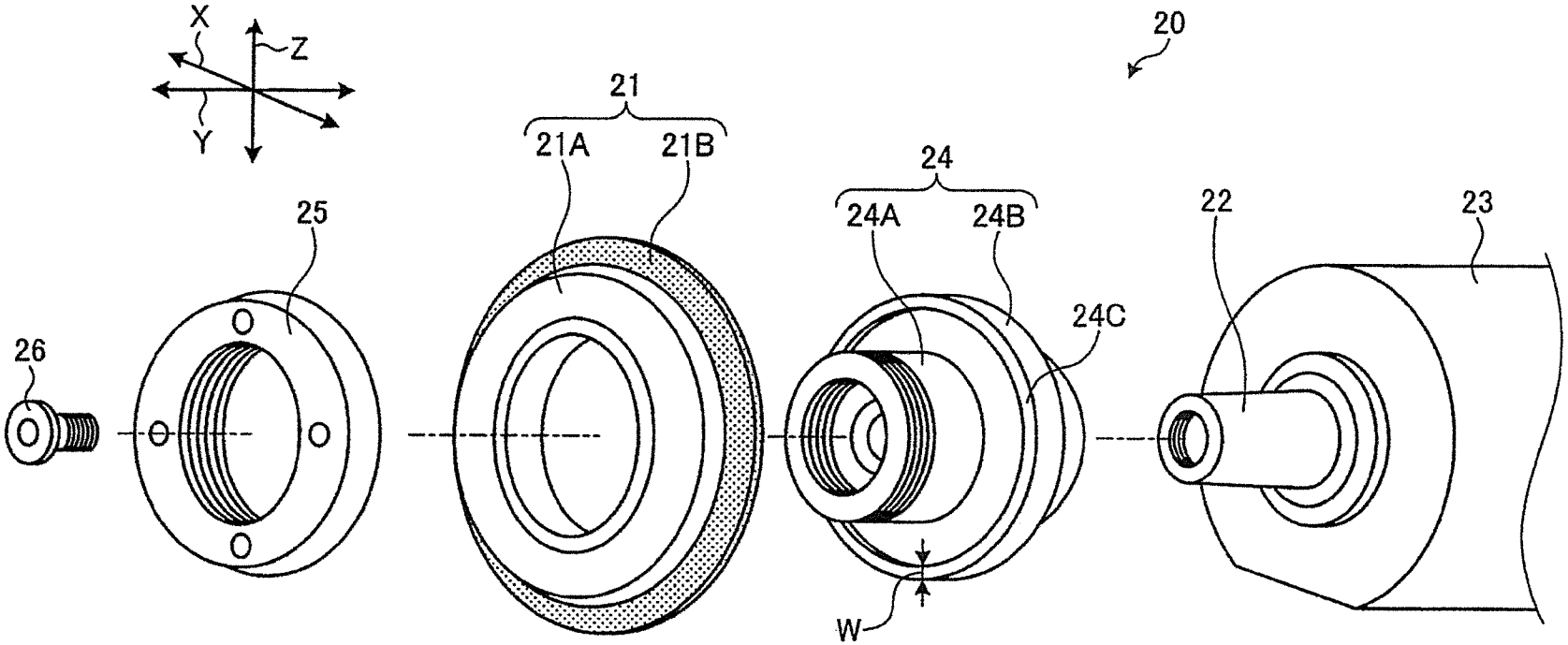
FIG. 3 is an exploded perspective view of a cutting unit of the cutting apparatus.

FIG. 1 is a perspective view of the cutting apparatus according to the present embodiment. FIG. 2 is an elevational view, partly in cross section, of a processing feed unit of the cutting apparatus. FIG. 3 is an exploded perspective view of a cutting unit of the cutting apparatus. The cutting apparatus, denoted by 1, is an apparatus for cutting a plate-shaped workpiece 200 to divide the workpiece 200 into individual device chips. According to the present embodiment, the workpiece 200 is a semiconductor wafer or optical device wafer in the shape of a disk made of a base material such as silicon, sapphire, gallium, or the like. The semiconductor wafer or optical device wafer as the workpiece 200 has a grid of projected dicing lines on a face side thereof, demarcating the face side into a plurality of areas where respective devices are formed. The cutting apparatus 1 cuts the workpiece 200 along the projected dicing lines to divide the workpiece 200 into individual device chips. A dicing tape 201 is stuck to the reverse side of the workpiece 200, and an annular frame 202 is stuck to a peripheral edge portion of the dicing tape 201. Therefore, the workpiece 200 is supported on the annular frame 202 by the dicing tape 201. The workpiece 200 may also be a packaged substrate, ceramics substrate, or glass substrate which is of a rectangular shape, as well as a disk-shaped wafer.

As depicted in FIG. 1, the cutting apparatus 1 includes a rotatable chuck table 10 for holding the workpiece 200 supported on the annular frame 202 under suction on a holding surface 11 thereof, a pair of cutting units 20 for cutting or processing the workpiece 200 held on the chuck table 10 with cutting blades 21 while supplying cutting water to the workpiece 200, a processing feed unit 30 for moving the chuck table 10 in X-axis directions, i.e., processing feed directions, a pair of indexing feed units 40 for moving the cutting units 20 in Y-axis directions, i.e., indexing feed directions, perpendicular to the X-axis directions, a pair of incising feed units 50 for moving the cutting units 20 in Z-axis directions, i.e., vertical incising feed directions, perpendicular to the X-axis directions and the Y-axis directions, and a control unit 60. Though the cutting apparatus 1 has the two cutting units 20 as illustrated in FIG. 1, the cutting apparatus 1 may have a single cutting unit 20.

The chuck table 10 is disposed on an upper surface of an apparatus body 2 that is in the form of a rectangular parallelepiped. The chuck table 10 includes the holding surface 11, referred to above, for placing the workpiece 200 under suction thereon, and a plurality of clamps 12 disposed around an outer circumferential edge of the holding surface 11 for fixing the annular frame 202 stuck to the dicing tape 201 to the holding surface 11. The chuck table 10 is of a disk shape and includes a portion made of porous ceramics or the like that serves as the holding surface 11. The chuck table 10 is connected to a vacuum suction source, not depicted, through a vacuum suction channel, not depicted, and holds the workpiece 200 placed on the holding surface 11 securely thereon under a vacuum developed and supplied from the vacuum suction source through the vacuum suction channel. The chuck table 10 is movable in the X-axis directions, i.e., the processing feed directions, over the upper surface of the apparatus body 2 by the processing feed unit 30, and is also rotatable about a vertical axis parallel to the Z-axis directions by a rotary actuator, not depicted.

The processing feed unit 30 moves the chuck table 10 in the X-axis directions parallel to the holding surface 11 to processing-feed the chuck table 10 and the cutting units 20 in the X-axis directions relatively to each other. As illustrated in FIG. 2, the processing feed unit 30 includes a pair of horizontal guide rails 31 extending in the X-axis directions, a horizontal ball screw 32 disposed between and parallel to the guide rails 31, and a table moving base 33 slidably mounted on the guide rails 31 and having a nut, not depicted, disposed therein which is threaded over the ball screw 32, so that the table moving base 33 can be moved in the X-axis directions along the guide rails 31 when the ball screw 32 rotates about its own axis. A support base 34 is erected on the table moving base 33 and supports the chuck table 10 thereon. A stepping motor, not depicted, for rotating the ball screw 32 about its own axis is coupled to one end of the ball screw 32. When the stepping motor is energized, the ball screw 32 is rotated about its own axis, moving the table moving base 33 and hence the chuck table 10 in the X-axis directions along the guide rails 31. The guide rails 31, the ball screw 32, and the stepping motor jointly function as an actuating mechanism for moving the table moving base 33 along the guide rails 31.

As depicted in FIG. 1, the cutting apparatus 1 includes a water-resistant cover 35 for preventing cutting water supplied to the workpiece 200 held on the chuck table 10 on the cutting from entering the processing feed unit 30, and a pair of bellows 36 coupled to the water-resistant cover 35. As depicted in FIG. 2, the water-resistant cover 35 is supported on a plurality of upstanding columns 37 mounted on the table moving base 33 and extends in covering relation to the table moving base 33. The water-resistant cover 35 has an upper wall 35A having a central opening 35A1 defined therein with the support base 34 extending therethrough, and a plurality of side walls 35B extending downwardly from respective side edges of the upper wall 35A. The water-resistant cover 35 is integrally formed of a resin material. A seal member, not depicted, is disposed between the edge of the upper wall 35A that defines the central opening 35A1 and the outer peripheral surface of the support base 34. The bellows 36 are coupled respectively to opposite two of the side walls 35B, and extend in the X-axis directions, i.e., the processing feed directions, over the ball screw 32.

A portal support structure 3 that extends in the Y-axis directions is mounted on the upper surface of the apparatus body 2 and extends over the chuck table 10. The indexing feed units 40 and the incising feed units 50 are mounted on the portal support structure 3. The indexing feed units 40 move the cutting units 20 in the Y-axis directions, i.e., the indexing feed directions, parallel to the holding surface 11 and perpendicular to the X-axis directions to indexing-feed the chuck table 10 and the cutting units 20 in the Y-axis directions relatively to each other. As illustrated in FIG. 1, the indexing feed units 40 include a pair of horizontal guide rails 41 mounted on the portal support structure 3 and extending in the Y-axis directions, a pair of horizontal ball screws 42 disposed between and parallel to the guide rails 41, and a pair of blade moving bases 43 slidably mounted on the guide rails 41 and having respective nuts, not depicted, disposed therein which are threaded over the respective ball screws 42, so that the blade moving bases 43 can be moved along the guide rails 41 when the ball screws 42 rotate about their own axes. Stepping motors 44 for rotating the respective ball screws 42 about their own axes are coupled to respective ends of the ball screws 42. When the stepping motors are energized, the ball screws 42 are rotated about their own axis, moving the blade moving bases 43 in the Y-axis directions along the guide rails 41.

The incising feed units 50 move the cutting units 20 in the Z-axis directions, i.e., the vertical incising feed directions, perpendicular to the holding surface 11 to incising-feed the chuck table 10 and the cutting units 20 in the Z-axis directions relatively to each other. As depicted in FIG. 1, each of the incising feed units 50 includes a pair of vertical guide rails 51 disposed on one of the blade moving base 43 and extending in the Z-axis directions, a ball screw 52 disposed between and parallel to the guide rails 51, and an incising movable base 53 slidably mounted on the guide rails 51 and having a nut, not depicted, disposed therein which is threaded over the ball screw 52, so that the incising movable base 53 can be moved along the guide rails 51 when the ball screw 52 rotates about its own axis. One of the cutting units 20 is supported on the incising movable base 53. A stepping motor 54 for rotating the ball screw 52 about its own axis is coupled to one end of the ball screw 52. When the stepping motor 54 is energized, the ball screw 52 is rotated about its own axis, moving the incising movable base 53 in the Z-axis directions along the guide rails 51.

The cutting units 20 are movable by the indexing feed units 40 and the incising feed units 50 to place the cutting blades 21 at any arbitrary positions on the holding surface 11 of the chuck table 10. As depicted in FIG. 3, each of the cutting units 20 includes a housing 23, a spindle 22, a mount flange 24, one of the cutting blades 21, and a fixing nut 25. Each of the cutting units 20 also includes a nozzle, not depicted, for supplying cutting water to the cutting edge of the cutting blade 21 and a processing point where the cutting blade 21 cuts the workpiece 200 during a cutting process.

The cutting blade 21 comprises a so-called hub blade and has an annular cutting edge 21B secured to the outer periphery of a disk-shaped base 21A made of metal such as aluminum, for example, for cutting the workpiece 200. The cutting edge 21B is made of abrasive grains of diamond, CBN (Cubic Boron Nitride), or the like and a bonding material of metal, resin, or the like mixed with the abrasive grains, and has a predetermined thickness. The cutting blade 21 may alternatively comprise a washer blade that has a cutting edge only.

While the cutting blade 21 is in contact with the workpiece 200, the spindle 22 rotates the cutting blade 21 to cause the cutting blade 21 to cut the workpiece 200. The spindle 22 is partly housed in the housing 23, which is supported on the incising movable base 53 of one of the incising feed units 50. The spindle 22 and the cutting blade 21 of the cutting unit 20 have respective axes extending coaxially parallel to the Y-axis directions. The spindle 22 has an end portion projecting out of an end of the housing 23. The other end of the spindle 22 is coupled to an electric motor, not depicted, for rotating the spindle 22 about its own axis. The mount flange 24 is mounted on the outer circumferential surface of the end portion of the spindle 22 that projects from the housing 23.

The mount flange 24 supports the cutting blade 21 thereon. The mount flange 24 is made of metal and includes a hollow cylindrical boss 24A fitted over the outer circumferential surface of the end portion of the spindle 22 and a flange 24B extending radially outwardly from the outer circumferential surface of the boss 24A. The end portion of the spindle 22 is fitted in the boss 24A, and a bolt 26 is axially threaded through the boss 24A into the end portion of the spindle 22, thereby fastening the mount flange 24 to the spindle 22. The cutting blade 21 is fitted over the outer circumferential surface of the boss 24A and held axially against the flange 24B, and the fixing nut 25 is threaded over the outer circumferential surface of the boss 24A and held axially against the base 21A of the cutting blade 21. The base 21A of the cutting blade 21 is thus sandwiched and secured in place between the fixing nut 25 and the mount flange 24. The flange 24B of the mount flange 24 has an axial end face 24C that is held in abutment against the base 21A of the cutting blade 21, thereby supporting the cutting blade 21. As depicted in FIG. 1, each of the cutting units 20 has an image capturing device 29 for capturing an image of the upper surface of the workpiece 200 on the chuck table 10. The image capturing device 29 is fixedly mounted on the cutting unit 20, so that the image capturing device 29 is movable in unison with the cutting unit 20. The image capturing device 29 has a charge coupled device (CCD) camera, not depicted, for capturing an image of an area to be divided of the workpiece 200 that is held on the chuck table 10. The CCD camera sends a captured image of the workpiece 200 to the control unit 60, which uses the image in an alignment process for positioning the cutting blades 21 with respect to the workpiece 200 on the chuck table 10.

The cutting apparatus 1 further includes a cassette elevator 75 for placing thereon a cassette 70 housing workpieces 200 that are to be cut and have been cut and moving the cassette 70 placed thereon in the Z-axis directions, cleaning means 80 for cleaning workpieces 200 that have been cut, and delivery means, not depicted, for delivering a workpiece 200 between a cassette 70, the chuck table 10, and the cleaning means 80.

As described above, the cutting blade 21 has its base 21A sandwiched and secured in position between the fixing nut 25 and the end face 24C of the mount flange 24. If fragments of the aluminum that the base 21A is made of are deposited on the end face 24C of the mount flange 24, then the end face 24C of the mount flange 24 may not be flat. Furthermore, the end face 24C of the mount flange 24 may not lie perpendicularly to the central axis of the spindle 22. In these cases, when the spindle 22 rotates about its own axis, the cutting blade 21 held against the end face 24C of the mount flange 24 may possibly wobble or fluctuate, and may not precisely cut the workpiece 200 on the chuck table 10. To solve such a problem, the cutting apparatus 1 has an end face correction unit 100 for correcting the end face 24C of the mount flange 24. The end face correction unit 100 polishes the end face 24C of the mount flange 24 periodically or upon cutting blade replacement to correct the angle between the end face 24C and the central axis of the spindle 22 into a right angle and also to planarize the end face 24C into a flat surface.

As illustrated in FIG. 2, the end face correction unit 100 is fixedly mounted on the table moving base 33 and extends vertically through the water-resistant cover 35 at a position adjacent to the chuck table 10. Though FIG. 2 illustrates only one end face correction unit 100, the cutting apparatus 1 actually has two end face correction units 100 disposed respectively at two corners of the water-resistant cover 35 in association with the respective cutting units 20, as illustrated in FIG. 1.

Each of the end face correction units 100 includes a grinding stone holder 102 that holds a polishing grinding stone 101 for polishing the end face 24C and a positioning unit 103 coupled to the grinding stone holder 102 for vertically moving the polishing grinding stone 101 along the Z-axis directions. Each of the end face correction units 100 is positioned away from, i.e., opposite, the direction in which cutting water supplied in a cutting process is scattered. The positioning unit 103 is fixedly mounted on the table moving base 33. With the end face correction units 100 thus positioned, cutting water and debris produced from the workpiece 200 at the time it is cut by the cutting blade 21 are prevented from being applied to the polishing grinding stone 101. Each of the end face correction units 100 may include a cover, not depicted, attached to the water-resistant cover 35 and openably covering the polishing grinding stone 101 and the grinding stone holder 102. When the end face correction unit 100 with the cover is used, the cover is open and the polishing grinding stone 101 polishes the end face 24C. When the end face correction unit 100 with the cover is not used, the cover is closed, covering the polishing grinding stone 101. The cover is thus effective to prevent cutting water and debris from the workpiece 200 from being applied to the polishing grinding stone 101 of the end face correction unit 100.

The polishing grinding stone 101 is made of abrasive grains of white alundum (WA), green carborundum (GC), or the like that are bonded together by a resin material. The polishing grinding stone 101 has a correction face 101A for correcting the end face 24C of the mount flange 24 in contact therewith. The correction face 101A is of a height slightly larger than the radial width W (see FIG. 3) of the end face 24C of the mount flange 24. The grinding stone holder 102 is disposed in a space outside (upper side) of the water-resistant cover 35, and holds the polishing grinding stone 101 such that the correction face 101A of the polishing grinding stone 101 faces outwardly of the cutting apparatus 1 in the Y-axis directions. In other words, the correction face 101A of the polishing grinding stone 101 lies parallel to both the X-axis directions and the Z-axis directions.

The positioning unit 103, which comprises a pneumatic cylinder or a hydraulic cylinder, for example, places the grinding stone holder 102 that holds the polishing grinding stone 101 selectively in an operative position wherein the correction face 101A of the polishing grinding stone 101 is held in contact with the end face 24C of the mount flange 24 and a retracted position wherein the correction face 101A of the polishing grinding stone 101 is retracted away from end face 24C of the mount flange 24. Specifically, when the cutting unit 20 cuts the workpiece 200, the positioning unit 103 is shortened to place the grinding stone holder 102 in the retracted position wherein the polishing grinding stone 101 is retracted away from the mount flange 24, as illustrated in FIG. 2. When the polishing grinding stone 101 polishes the end face 24C of the mount flange 24, the positioning unit 103 is lengthened to place the grinding stone holder 102 in the operative position wherein the polishing grinding stone 101 is able to be held in contact with the end face 24C of the mount flange 24, as described later.

Figure 4:
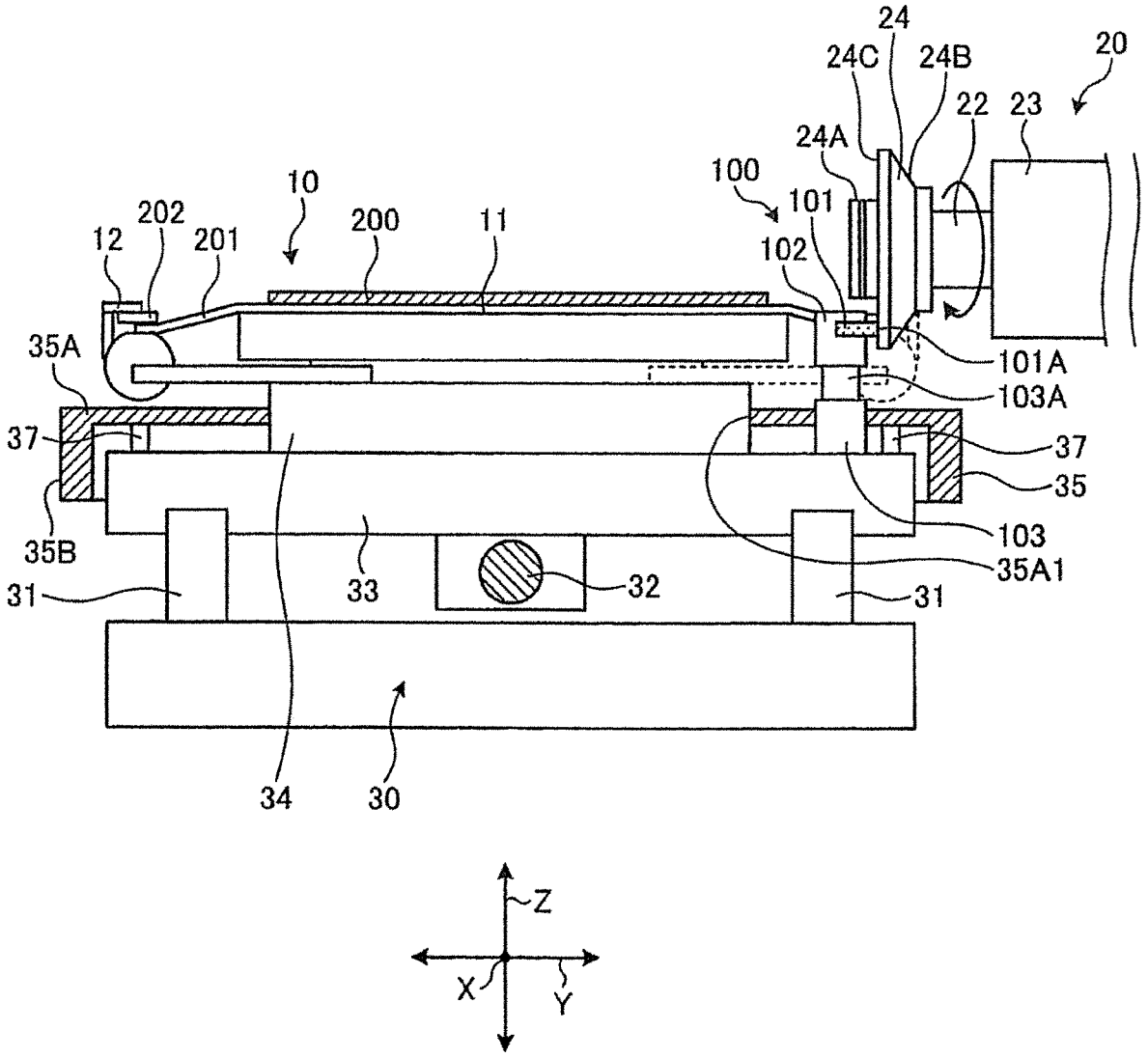
FIG. 4 is an elevational view, partly in cross section, illustrating the manner in which the end face of a mount flange is being corrected by an end face correction unit.
Figure 5:
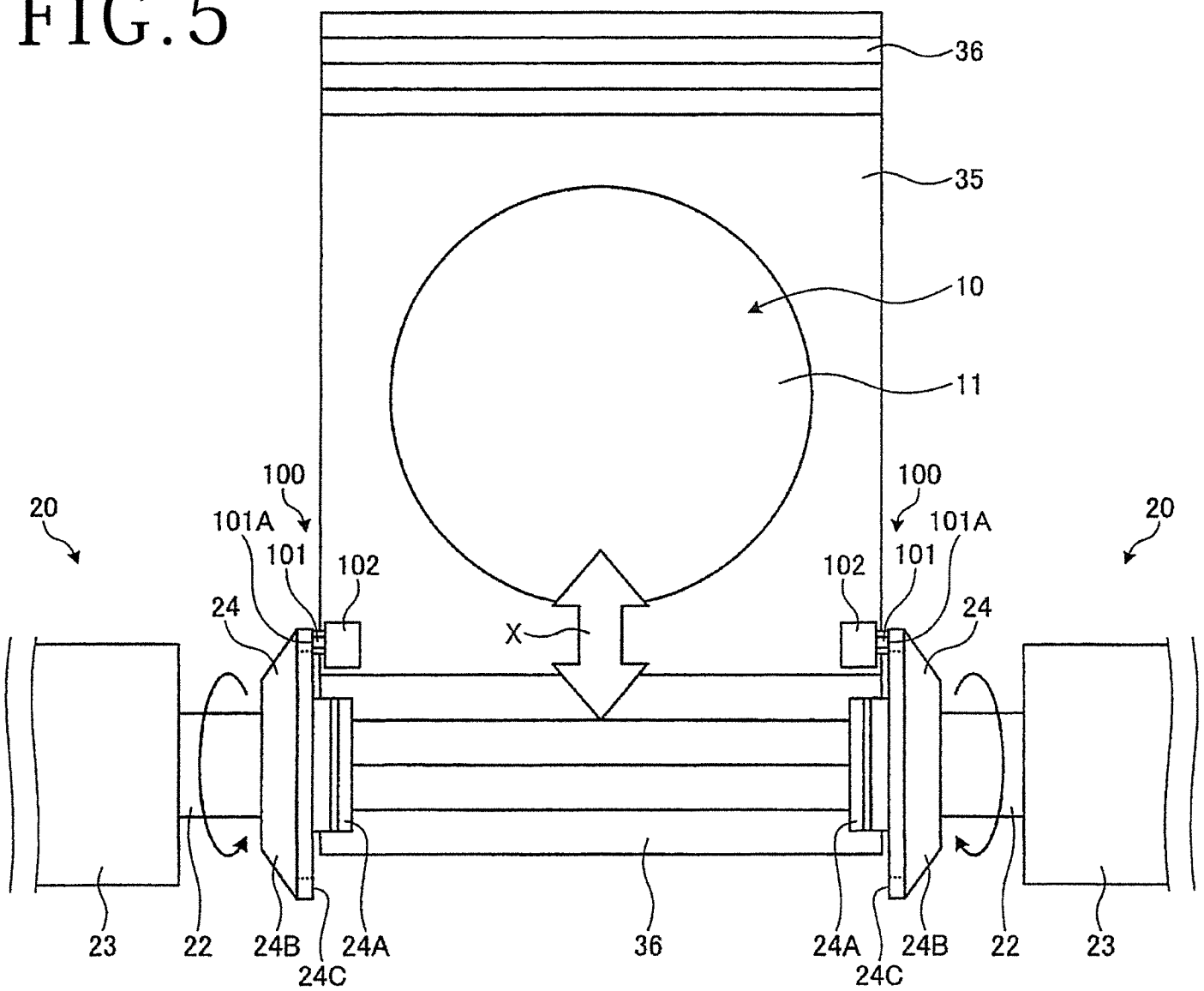
FIG. 5 is a plan view of the parts illustrated in FIG. 4.
Figure 6:
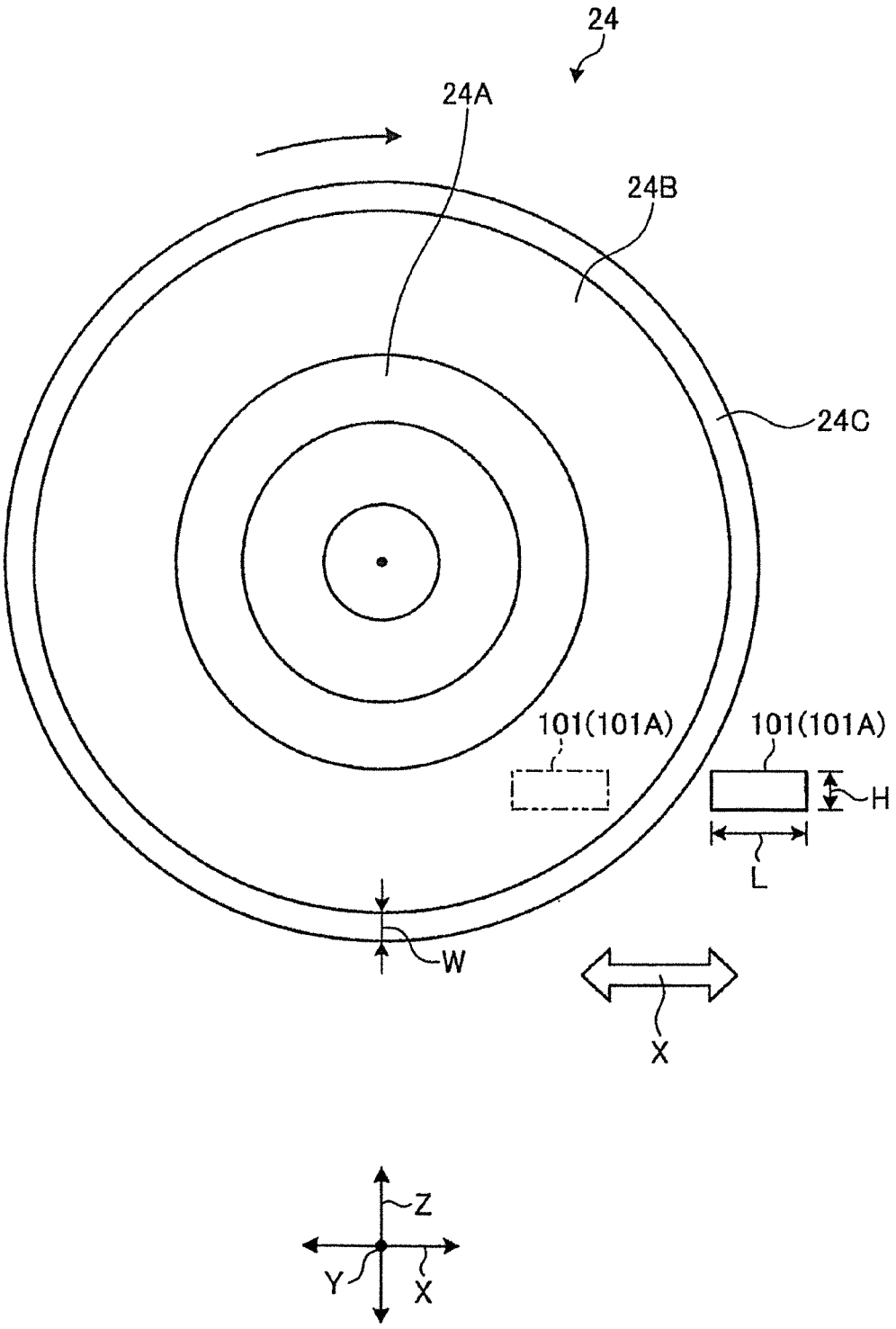
FIG. 6 is an enlarged view depicting some of the parts illustrated in FIG. 4 from a different direction.

An operation sequence of an end face correction process carried out by each of the end face correction units 100 will be described below. FIG. 4 is an elevational view, partly in cross section, illustrating the manner in which the end face 24C of the mount flange 24 is being corrected by the end face correction unit 100. FIG. 5 is a plan view of the parts illustrated in FIG. 4. FIG. 6 is an enlarged view depicting some of the parts illustrated in FIG. 4 from a different direction.

The end face correction process is performed periodically or when the mount flange 24 of the cutting unit 20 is replaced with another one. The operator shuts down the cutting apparatus 1, and removes the fixing nut 25 and the cutting blade 21 (see FIG. 2) of the cutting unit 20. The operator may then remove the mount flange 24 from the spindle 22 and install a new mount flange 24 on the spindle 22. At this time, the end face 24C of the mount flange 24 is exposed, as depicted in FIGS. 4 and 5. As illustrated in FIG. 2, the positioning unit 103 is shortened to place the grinding stone holder 102 that holds the polishing grinding stone 101 in the retracted position.

Then, the operator instructs the control unit 60 to start the end face correction process. The control unit 60 actuates the indexing feed unit 40 and the incising feed unit 50 to place the cutting unit 20 in a predetermined initial position, as depicted in FIGS. 4 and 5, and actuates the positioning unit 103 of the end face correction unit 100 to raise a piston rod 103A thereof to place the grinding stone holder 102 in a position wherein the grinding stone holder 102 faces the end face 24C.

Then, the control unit 60 actuates the indexing feed unit 40 to indexing-feed the cutting unit 20 in one of the Y-axis directions to a predetermined position wherein the end face 24C of the mount flange 24 and the correction face 101A of the polishing grinding stone 101 are held in contact with each other. The instant that the mount flange 24 and the polishing grinding stone 101 are brought into contact with each other may be detected from a change in the value of a weak current flowing through the mount flange 24, i.e., a change in the value of a resistance of current pass. Alternatively, the instant that the mount flange 24 and the polishing grinding stone 101 are brought into contact with each other may be detected from an image captured of the mount flange 24 and the polishing grinding stone 101 by a camera or the like. The control unit 60 stops the operation of the indexing feed unit 40 at the instant that the mount flange 24 and the polishing grinding stone 101 are brought into contact with each other.

Then, the control unit 60 controls the indexing feed unit 40 to indexing-feed the mount flange 24 a predetermined distance in the one of the Y-axis directions referred to above while the spindle 22 is in rotation. Furthermore, the control unit 60 controls the processing feed unit 30 to move the table moving base 33, i.e., the polishing grinding base 101, reciprocably in the X-axis directions so that the polishing grinding base 101 will contact the end face 24C in its entirety, thereby polishing the end face 24C with the polishing grinding stone 101. As depicted in FIG. 6, the correction face 101A of the polishing grinding stone 101 has a height H and a width L that are slightly larger than the radial width W of the end face 24C of the mount flange 24. Therefore, the entire correction face 101A of the polishing grinding stone 101 is kept in contact with the end face 24C and is prevented from being unevenly worn when the polishing grinding stone 101 is moved reciprocably in the X-axis directions across the end face 24C from one side to the other of the end face 24C. In this manner, the end face 24C of the mount flange 24 can be planarized into a flat surface, and the angle between the end face 24C and the central axis of the spindle 22 is corrected into a right angle. After the control unit 60 has moved the table moving base 33 reciprocably in the X-axis directions over a predetermined period of time or a predetermined number of times, the control unit 60 finishes the end face correction process. In the operation sequence illustrated above, the control unit 60 performs the end face correction process, for example. However, the operator may actuate each of the units to perform the end face correction process.

As described above, the cutting apparatus 1 according to the above embodiment includes the chuck table 10 for holding the plate-shaped workpiece 200 thereon, the cutting unit 20, for cutting the workpiece 200 held on the chuck table 10 with the cutting blade 21 secured in place on the distal-end portion of the spindle 22 by the mount flange 24 mounted on the distal-end portion of the spindle 22, the indexing feed unit 40 for moving the cutting unit 20 in the indexing feed directions parallel to the axial directions of the spindle 22, the processing feed unit 30 for moving the chuck table 10 in the processing feed directions perpendicular to the indexing feed directions, and the end face correction unit 100 for correcting the end face 24C of the mount flange 24 that supports the cutting blade 21 in contact therewith. The processing feed unit 30 includes the table moving base 33 that supports the chuck table 10 thereon, and the actuating mechanism for moving the table moving base 33, the actuating mechanism including the guide rails 31, the ball screw 32, and the stepping motor. The end face correction unit 100 is fixedly mounted on the table moving base 33.

With the above arrangement, since the end face correction unit 100 for correcting the end face 24C of the mount flange 24 is mounted on the table moving base 33 of the processing feed unit 30 for moving the chuck table 10 in the processing feed directions, it is not necessary to replace the chuck table with a dedicated chuck table, to put in a dedicated jig with a polishing grinding stone secured thereto, and to adjust the position of the dedicated jig to place the polishing grinding stone and the end face 24C of the mount flange 24 into given working positions. In addition, after the end face 24C of the mount flange 24 has been polished, it is not necessary to replace the dedicated chuck table with the chuck table that supports the workpiece, and to bring the cutting blade 21 into contact with the surface of the chuck table that has replaced the dedicated chuck table to establish again a reference position for an incising feed direction. Accordingly, the number of man-hours involved in the end face correction process is reduced, and the end face correction unit 100 mounted on the table moving base 33 is capable of easily correcting the end face 24C of the mount flange 24.

According to the present embodiment, moreover, the end face correction unit 100 includes the grinding stone holder 102 that holds the polishing grinding stone 101, and the positioning unit 103 for placing the grinding stone holder 102 selectively in the operative position wherein the correction face 101A of the polishing grinding stone 101 is held in contact with the end face 24C of the mount flange 24 and the retracted position wherein the correction face 101A of the polishing grinding stone 101 is retracted away from the end face 24C of the mount flange 24. When the cutting unit 20 cuts the workpiece 200, the positioning unit 103 can place the grinding stone holder 102 that holds the polishing grinding stone 101 in the retracted position wherein the polishing grinding stone 101 and the grinding stone holder 102 are prevented from obstructing the cutting operation of the cutting unit 20. When the cutting unit 20 stops cutting the workpiece 200, the positioning unit 103 can place the grinding stone holder 102 that holds the polishing grinding stone 101 in the operative position wherein the correction face 101A of the polishing grinding stone 101 is easily held in contact with the end face 24C of the mount flange 24, allowing the correction face 101A of the polishing grinding stone 101 to correct the end face 24C.

The present invention is not limited to the embodiment illustrated above. Various changes and modifications may be made therein without departing from the scope of the invention. According to the above embodiment, the cutting apparatus 1 includes the two cutting units 20 disposed in confronting relation to each other in the Y-axis directions, and the two end face correction units 100 disposed in respective positions associated with the cutting units 20, respectively. Therefore, the end faces 24C of the mount flanges 24 of the respective cutting units 20 can simultaneously be corrected by the respective end face correction units 100. However, the present invention is not limited to the illustrated embodiment having the two end face correction units 100. Rather, the cutting apparatus 1 according to the present invention may have a single cutting unit 20 and a single end face correction unit 100 disposed in a position associated with the cutting unit 20.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

a chuck table for holding a plate-shaped workpiece thereon;

a cutting unit for cutting the workpiece held on the chuck table with a cutting blade secured in place on a distal-end portion of a spindle by a mount flange mounted on the distal-end portion of the spindle;

an indexing feed unit for moving the cutting unit in indexing feed directions parallel to axial directions of the spindle;

a processing feed unit for moving the chuck table in processing feed directions perpendicular to the indexing feed directions; and an end face correction unit for correcting an end face of the mount flange that supports the cutting blade in contact therewith;

wherein the processing feed unit includes:

a table moving base that supports the chuck table thereon; and an actuating mechanism for moving the table moving base; and the end face correction unit is permanently mounted on the table moving base;

wherein the end face correcting unit comprises:

a holder that holds a polishing grinding stone; and a positioning unit for placing the holder selectively in an operative position wherein the polishing grinding stone is held in contact with the end face of the mount flange and a retracted position wherein the polishing grinding stone is retracted away from the mount flange, wherein the positioning unit moves the holder and the polishing grinding stone relative to the table moving base; and wherein the table moving base has an upper surface and the positioning unit is positioned on the upper surface of the table moving base and wherein the positioning unit moves the holder and the polishing grinding stone upward away from the table moving base to place the holder in the operative position and wherein the positioning unit moves the holder and the polishing grinding stone downward toward the table moving base to place the holder in the retracted position.

2. A cutting apparatus comprising:

a chuck table for holding a plate-shaped workpiece thereon;

a cutting unit for cutting the workpiece held on the chuck table with a cutting blade secured in place on a distal-end portion of a spindle by a mount flange mounted on the distal-end portion of the spindle;

an indexing feed unit for moving the cutting unit in indexing feed directions parallel to axial directions of the spindle;

a processing feed unit for moving the chuck table in processing feed directions perpendicular to the indexing feed directions; and an end face correction unit for correcting an end face of the mount flange that supports the cutting blade in contact therewith;

wherein the processing feed unit includes:

a table moving base that supports the chuck table thereon; and an actuating mechanism for moving the table moving base; and the end face correction unit is permanently mounted on the table moving base;

wherein the end face correcting unit comprises:

a holder that holds a polishing grinding stone; and a positioning unit for placing the holder selectively in an operative position wherein the polishing grinding stone is held in contact with the end face of the mount flange and a retracted position wherein the polishing grinding stone is retracted away from the mount flange, wherein the positioning unit moves the holder and the polishing grinding stone relative to the table moving base; and wherein the positioning unit is shortened to place the holder in the retracted position and wherein the positioning unit is lengthened to place the holder in the operative position.

3. The cutting apparatus according to claim 2, further comprises a control unit, the control unit controlling the positioning unit to cause the holder to selectively move between the retracted and operative positions.

4. A cutting apparatus comprising:

a chuck table for holding a workpiece thereon, the chuck table having a horizontally positioned holding surface;

a cutting unit for cutting the workpiece held on the chuck table with a cutting blade secured in place on a distal-end portion of a spindle by a mount flange mounted on the distal-end portion of the spindle, the cutting unit being moveable in first horizontal indexing feed directions parallel to axial directions of the spindle;

a table moving base that supports the chuck table thereon, the table moving base being moveable in horizontal processing feed directions perpendicular to the indexing feed directions, the movement of the table moving base in one of the processing feed directions moving the chuck table in the one of the processing feed directions; and a holder that holds a polishing grinding stone; and a positioning unit for selectively moving the holder between an operative position and a retracted position, wherein when the holder is moved into the operative position the polishing grinding stone may be held in contact with an end face of the mount flange to correct the end face of the mount flange, wherein when the holder is moved into the retracted position, the polishing grinding stone is retracted away from the mount flange;

wherein the positioning unit moves the holder and the polishing grinding stone relative to the table moving base; and wherein the table moving base has an upper surface and the positioning unit is positioned on the upper surface of the table moving base and wherein the positioning unit moves the holder and the polishing grinding stone upward away from the table moving base to place the holder in the operative position and wherein the positioning unit moves the holder and the polishing grinding stone downward toward the table moving base to place the holder in the retracted position.

5. The cutting apparatus according to claim 4, further comprises a control unit, the control unit controlling the positioning unit to cause the holder to selectively move between the retracted and operative positions.

6. The cutting apparatus according to claim 4, comprising a second cutting unit for cutting the workpiece held on the chuck table with a second cutting blade secured in place on a distal-end portion of a second spindle by a second mount flange mounted on the distal-end portion of the second spindle, the second cutting unit being moveable in the first horizontal indexing feed directions parallel to axial directions of the second spindle; and a second holder that holds a second polishing grinding stone; and a second positioning unit for selectively moving the second holder between an operative position and a retracted position, wherein when the second holder is moved into the operative position the second polishing grinding stone may be held in contact with an end face of the second mount flange to correct the end face of the second mount flange, wherein when the second holder is moved into the retracted position, the second polishing grinding stone is retracted away from the second mount flange;

wherein the second positioning unit is fixedly mounted on the table moving base.

7. The cutting apparatus according to claim 6, further comprises a control unit, the control unit controlling the second positioning unit to cause the second holder to selectively move between the corresponding retracted and operative positions.

8. A cutting apparatus comprising:

a chuck table for holding a workpiece thereon, the chuck table having a horizontally positioned holding surface;

a cutting unit for cutting the workpiece held on the chuck table with a cutting blade secured in place on a distal-end portion of a spindle by a mount flange mounted on the distal-end portion of the spindle, the cutting unit being moveable in first horizontal indexing feed directions parallel to axial directions of the spindle;

a table moving base that supports the chuck table thereon, the table moving base being moveable in horizontal processing feed directions perpendicular to the indexing feed directions, the movement of the table moving base in one of the processing feed directions moving the chuck table in the one of the processing feed directions; and a holder that holds a polishing grinding stone; and a positioning unit for selectively moving the holder between an operative position and a retracted position, wherein when the holder is moved into the operative position the polishing grinding stone may be held in contact with an end face of the mount flange to correct the end face of the mount flange, wherein when the holder is moved into the retracted position, the polishing grinding stone is retracted away from the mount flange;

wherein the positioning unit moves the holder and the polishing grinding stone relative to the table moving base; and wherein the positioning unit is shortened to place the holder in the retracted position and wherein the positioning unit is lengthened to place the holder in the operative position.

9. A method of operating a cutting apparatus comprising a chuck table for holding a workpiece thereon, the chuck table having a horizontally positioned holding surface, a cutting unit for cutting the workpiece held on the chuck table with a cutting blade secured in place on a distal-end portion of a spindle by a mount flange mounted on the distal-end portion of the spindle, the cutting unit being moveable in first horizontal indexing feed directions parallel to axial directions of the spindle, a table moving base that supports the chuck table thereon, the table moving base being moveable in horizontal processing feed directions perpendicular to the indexing feed directions, the movement of the table moving base in one of the processing feed directions moving the chuck table in the one of the processing feed directions; and a moveable holder that holds a polishing grinding stone, the method comprising:

selectively moving the holder from a retracted position to an operative position;

when the holder is in the operative position, contacting the polishing grinding stone with an end face of the mount flange to correct the end face of the mount flange;

thereafter moving the holder back into the retracted position so that the polishing grinding stone is retracted away from the mount flange;

wherein the selectively moving the holder comprises moving the holder and the polishing grinding stone relative to the table moving base;

wherein the selectively moving the holder from the retracted position to the operative position comprises moving the holder and the polishing grinding stone upward away from the table moving base to place the holder in the operative position and wherein the moving the holder back into the retracted position comprises moving the holder and the polishing grinding stone downward toward the table moving base to place the holder in the retracted position.

10. A method of operating a cutting apparatus comprising a chuck table for holding a workpiece thereon, the chuck table having a horizontally positioned holding surface, a cutting unit for cutting the workpiece held on the chuck table with a cutting blade secured in place on a distal-end portion of a spindle by a mount flange mounted on the distal-end portion of the spindle, the cutting unit being moveable in first horizontal indexing feed directions parallel to axial directions of the spindle, a table moving base that supports the chuck table thereon, the table moving base being moveable in horizontal processing feed directions perpendicular to the indexing feed directions, the movement of the table moving base in one of the processing feed directions moving the chuck table in the one of the processing feed directions; and a moveable holder that holds a polishing grinding stone, the method comprising:

selectively moving the holder from a retracted position to an operative position;

when the holder is in the operative position, contacting the polishing grinding stone with an end face of the mount flange to correct the end face of the mount flange;

thereafter moving the holder back into the retracted position so that the polishing grinding stone is retracted away from the mount flange;

wherein the selectively moving the holder comprises moving the holder and the polishing grinding stone relative to the table moving base;

wherein the holder is coupled to a cylinder having an adjustable length and wherein the selectively moving the holder from the retracted position to the operative position comprises lengthening the cylinder; and wherein the moving the holder back into the retracted position comprises shortening the cylinder.

11. The method according to claim 10, wherein the cutting apparatus further comprises a control unit, the method further comprising:

the control unit controlling the movement of the holder between the retracted and operative positions.

12. The method according to claim 11, wherein the cutting apparatus further comprises:

a second cutting unit for cutting the workpiece held on the chuck table with a second cutting blade secured in place on a distal-end portion of a second spindle by a second mount flange mounted on the distal-end portion of the second spindle, the second cutting unit being moveable in the first horizontal indexing feed directions parallel to axial directions of the second spindle; and a second holder that holds a second polishing grinding stone; and a second moveable holder that holds a second polishing grinding stone;

the method further comprising:

selectively moving the second holder from a corresponding retracted position to a corresponding operative position;

when the second holder is in the operative position, contacting the second polishing grinding stone with an end face of the second mount flange to correct the end face of the second mount flange;

thereafter moving the second holder back into the corresponding retracted position so that the second polishing grinding stone is retracted away from the second mount flange;

wherein the second moveable holder is fixedly mounted on the table moving base.

13. The method according to claim 12, wherein the cutting apparatus further comprises a control unit, the method further comprising:

the control unit controlling the movement of the first and second holders between their respective retracted and operative positions.

* * * * *